US008099979B2

(12) United States Patent
Livni et al.

(10) Patent No.: US 8,099,979 B2
(45) Date of Patent: Jan. 24, 2012

(54) DYNAMIC ITEM OF JEWELRY

(76) Inventors: Tuvia Livni, Ra'anana (IL); Roi Livni, Ra'anana (IL); Matan Livni, Ra'anana (IL)

( * ) Notice: Subject to any disclaimer, the term of this patent is extended or adjusted under 35 U.S.C. 154(b) by 797 days.

(21) Appl. No.: 12/209,633

(22) Filed: Sep. 12, 2008

(65) Prior Publication Data

US 2010/0031701 A1 Feb. 11, 2010

(30) Foreign Application Priority Data

Aug. 7, 2008 (IL) ..... 193305

(51) Int. Cl.
*A44C 17/02* (2006.01)

(52) U.S. Cl. ..... 63/31; 63/26

(58) Field of Classification Search ..... None
See application file for complete search history.

(56) References Cited

U.S. PATENT DOCUMENTS

| | | | | |
|---|---|---|---|---|
| 645,909 | A * | 3/1900 | Boismaure | 63/31 |
| 680,873 | A * | 8/1901 | Lord | 63/20 |
| 763,846 | A * | 6/1904 | Boismaure | 63/31 |
| 1,550,011 | A * | 8/1925 | Cobb | 63/15 |
| 2,883,048 | A * | 4/1959 | Lentz | 206/562 |
| 5,228,317 | A * | 7/1993 | Hendricks | 63/15.7 |
| 5,992,177 | A * | 11/1999 | Beard | 63/29.1 |
| 6,408,647 | B1 * | 6/2002 | Koll | 63/31 |
| 6,612,132 | B2 * | 9/2003 | Kimura et al. | 63/31 |
| 6,820,442 | B2 * | 11/2004 | Kimura | 63/31 |
| 6,857,289 | B1 * | 2/2005 | Cheng | 63/31 |
| 7,536,874 | B2 * | 5/2009 | Ray et al. | 63/31 |
| 2003/0110797 | A1 * | 6/2003 | Kimura et al. | 63/31 |
| 2003/0172673 | A1 * | 9/2003 | Kimura | 63/29.1 |
| 2005/0022555 | A1 * | 2/2005 | Cheng | 63/31 |
| 2005/0160765 | A1 * | 7/2005 | Hintze | 63/31 |
| 2009/0241600 | A1 * | 10/2009 | Achmedschanow | 63/15 |

* cited by examiner

*Primary Examiner* — Jack W. Lavinder
(74) *Attorney, Agent, or Firm* — Venable LLP; Robert Kinberg

(57) ABSTRACT

A dynamic piece of jewelry, which comprises: a bezel comprising: a partially spherical base having a curved bottom and an essentially flat top; and plurality of prongs that extend in a tilted manner from said essentially flat top of the base, each of said prongs having a bottom end which is attached to said essentially flat top of said base, and a top end, and wherein said prongs are tilted such that they form a structure having an expanding cross section from the structure bottom to the structure top; a tooth at the top of each prong, for, jointly supporting a gemstone; a seat which supports said partially spherical base, said seat having a radius of curvature larger than the radius of curvature of said partially spherical base; a gemstone supported by said plurality of teeth at the top of said prongs; and a holder having a central hole, said holder being attached to said seat in such a manner that a top portion of the prongs including the gemstone protrude above said holder hole, and a bottom portion of said prongs and said partially spherical base being maintained below said holder, and wherein the cross section of said prongs structure at the holder level is slightly smaller than the hole, thereby enabling multi directional freedom of movement, although limited, of the bezel within said the limitation of said hole.

6 Claims, 6 Drawing Sheets

DYNAMIC ITEM OF JEWELRY

CROSS-REFERENCE TO RELATED APPLICATIONS

Priority is claimed herein to Application No. 193305 filed in Israel on Aug. 78, 2008, the disclosure of which is incorporated herein by reference in its entirety.

FIELD OF THE INVENTION

The present invention relates to a piece of jewelry with a tilted pivot bezel. Specifically, this invention relates to a piece of jewelry positioned on a multi-directional freedom of movement pivot.

BACKGROUND OF THE INVENTION

Well-cut diamonds look wonderful regardless of the environmental conditions at the location they are placed. Nevertheless, a diamond shows different performance qualities depending on the lighting, how it is held, its surrounding and even the clothes the person who holds it wears.

Diamond's performance qualities are defined by Brightness, Fire, Scintillation and Contrast.

Brightness is the overall return of light from the diamond. A well-cut diamond will have great brightness. As the observer moves closer to the diamond, and consequently blocks more light, he will see the diamond's contrast pattern become more apparent (i.e. areas of light and darkness which compliment each other).

Fire in where the diamond breaks white light into spectral colors. All diamonds naturally disperse light but certain geometric relationships in the faceting enhance this quality more than others. A well-cut diamond, regardless of shape, should have healthy balance of colored sparkle in its performance (i.e. Fire).

Scintillation is white and colored sparkle associated with movement (i.e. the relative movement between the diamond and its observer). The dazzle of scintillation is a quality many people are drawn in diamonds.

Contrast is the pattern of light and dark areas which shifts with sparkle during movement. If an observer rocks a well-cut stone in his hand it will put on a fireworks display of bright colors and white sparkles enhanced by shifting contrast.

At the turn of the century diamonds' show rooms were kept dim, with low hanging electric lights to maximize dispersion. Today's jewelry stores show rooms are brighter in overall, but still use spotlights to exaggerate the effect of Fire. The use of modern LED and directional fiber-optic lighting at close range can create even more intensity. Scintillation is best produced by a mixture of overhead diffused or reflected light accompanied by strategically placed spotlighting. High-end jewelry stores such as Cartier often have bright lights reflecting from wall, small directional spots and additional pinpoint LED or fiber optic lighting positioned inside the case. In such an environment an observer can see sparkle just by changing his position relative to the diamond. One can generate this effect at home with recessed canned lighting or with track lighting, but the number of places outside a jewelry store with strategically reflected and directional light are few.

Generally, diamonds are stationary attached to a ring by means of a bezel. The effects of Scintillation and Contrast are increased when the diamond orientation is changed with respect to the viewer eye.

The present invention comprises a dynamic bezel which dynamically changes the relative orientation of the diamond with respect to the viewer eye therefore increases the Scintillation and Contrast effects.

It is an object of the invention to provide a piece of jewelry comprising a dynamic bezel, positioned on a multi-directional freedom of movement pivot, in order to generate a relative position change effect between the observer and the piece of jewelry.

It is another object of the present invention to increase the Scintillation and Contrast performance qualities of a diamond, positioned on top of the dynamic bezel, due to the relative position change effect between the observer and the dynamic bezel.

It is yet another object of the invention to provide a piece of jewelry comprising a dynamic bezel with the ability to tilt around a central axis in different directions, when the piece of jewelry slightly moves, and eventually to return to the initial vertical position, when the movement of said piece of jewelry stops.

It is a further object of the invention to provide a piece of jewelry comprising a dynamic bezel with the ability to tilt around a central axis in different directions, when the piece of jewelry slightly moves, without using an additional energy source.

It is yet another object of the invention to provide a piece of jewelry which is shaped in any desired shape, and which comprises a dynamic bezel.

It is still another object of the invention to provide a piece of jewelry, comprising a dynamic bezel, which is set with gems, pearls or gold and in any form of setting.

Other objects and advantages of the present invention will become apparent as the description proceeds.

SUMMARY OF THE INVENTION

The present invention relates to a dynamic piece of jewelry, which comprises: A. a bezel which comprises: (a) a partially spherical base having a curved bottom and an essentially flat top; (b) plurality of prongs that extend from said essentially flat top of the base, each of said prongs having a bottom end which is attached to said essentially flat top of said base, and a top end, and wherein said prongs are tilted such that they form a structure having an expanding cross section from the structure bottom to the structure top; and a tooth at the top of each prong, for supporting a gemstone. B. a seat for supporting said partially spherical base, said seat having a radius of curvature larger than the radius of curvature of said partially spherical base; C. a gemstone supported by said plurality of teeth at the top of the prongs; and D. a holder having a central hole, said holder being attached to said seat in such a manner that the top of the prongs including the gemstone protrude above said holder hole, while said partially spherical base being maintained below said holder, and wherein the cross section of said prongs structure at the holder level is slightly smaller than the hole, thereby enabling multi directional freedom of movement, although limited, of the bezel within said hole.

Preferably, the energy for tilting of the bezel around the multi-directional freedom of movement pivot central axis is derived from the movement of the person wearing said dynamic piece of jewelry solely.

Preferably, the holder comprises inner curbs that limit the movement of the bezel.

Preferably, the seat has a partially concave structure.

In another embodiment, the portion of the seat which supports said partially spherical base of the bezel is flat.

Preferably, the bezel is prong setting type bezel.

DETAILED DESCRIPTION

Figure 1A:
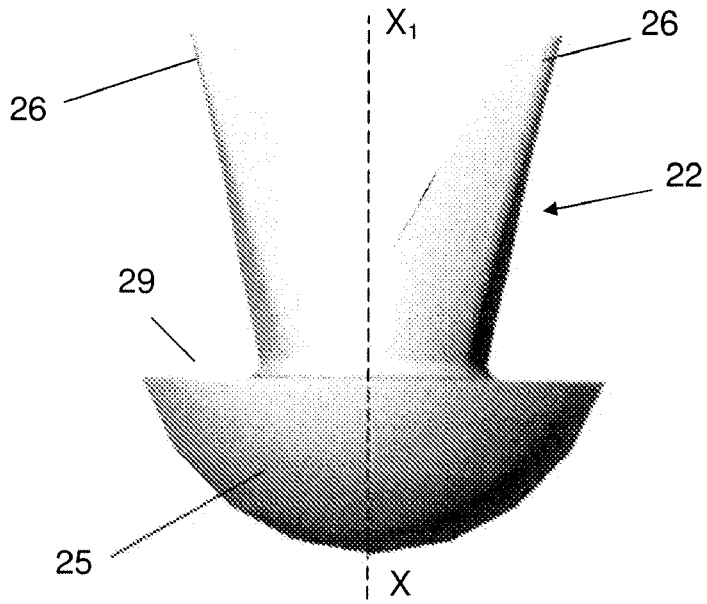
FIG. 1*a* is a side view of a dynamic prong setting bezel.
Figure 1B:
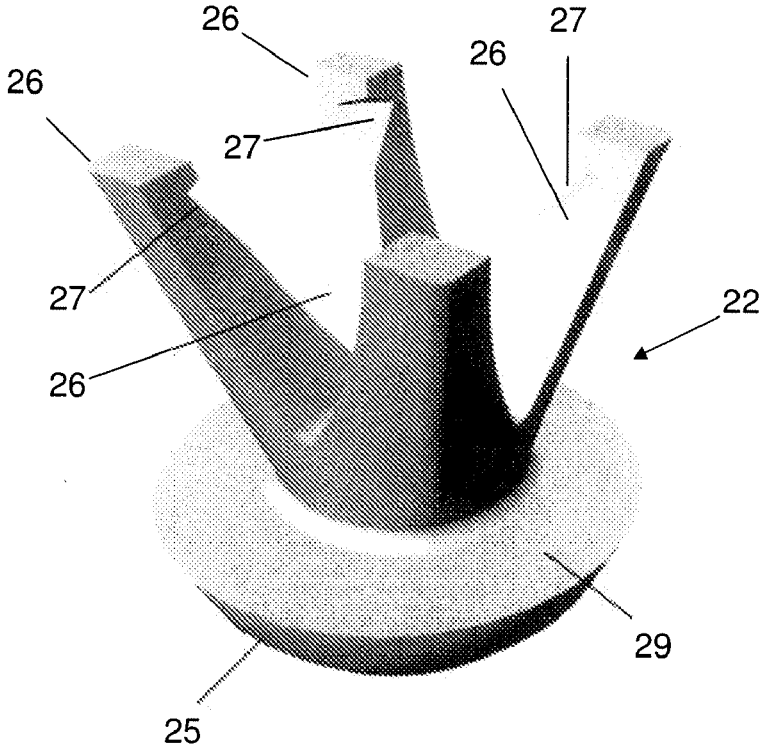
FIG. 1*b* is a perspective view of a dynamic prong setting bezel.

FIGS. 1*a* and 1*b* show a dynamic prong setting bezel 22 for a gemstone. The dynamic prong setting bezel 22 comprises plurality of prongs 26 at the upper side of the bezel, for holding a gemstone. The prongs comprise teeth 27, in which a gemstone (not shown) seats. Bezel 22 has a partially spherical base 25 at its bottom, which enables the bezel to have multi-directional freedom of movement. The partially spherical shape of base 25 along with the bezel and gemstone (not shown) weight enable the bezel to tilt its central axis x-x1 in different directions and to eventually, when the gemstone become stationary, return to its initial vertical position. The movement of the bezel and gemstone is caused due to the user movement and it is eventually stops after the user movement terminates.

As best shown in FIG. 1*b*, the plurality of prongs 26 extend in a tilted manner from the essentially flat top 29 of base 25, each of said prongs has a bottom end which is attached to said essentially flat top 29 of said base, and a top end. The prongs 26 are tilted such that they form a structure having an expanding cross section from the structure bottom to the structure top.

Figure 2A:
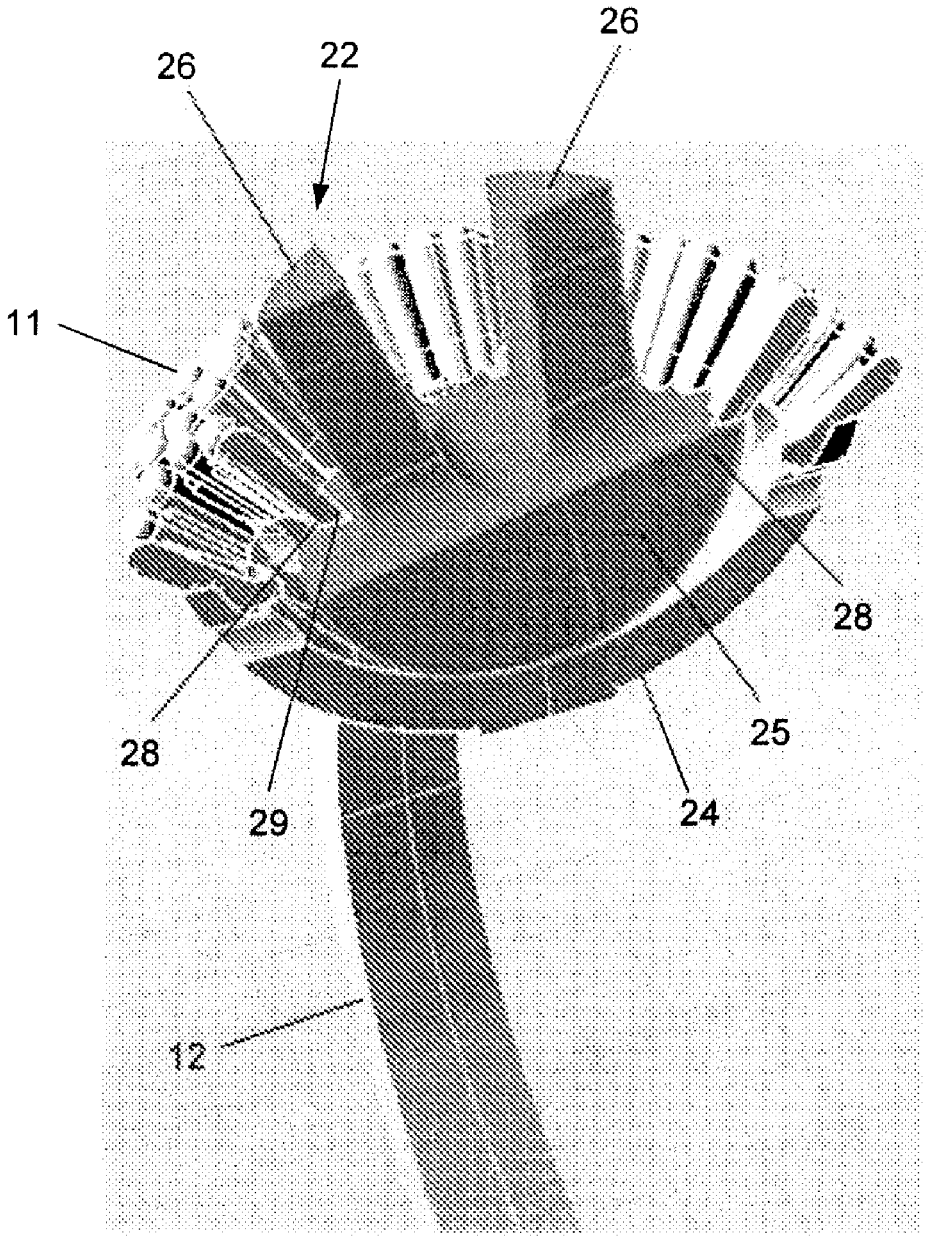
FIGS. 2*a*-2*c* are cut-away views of a ring comprising a dynamic bezel tilting within its partially spherical concave seat.
Figure 2B:
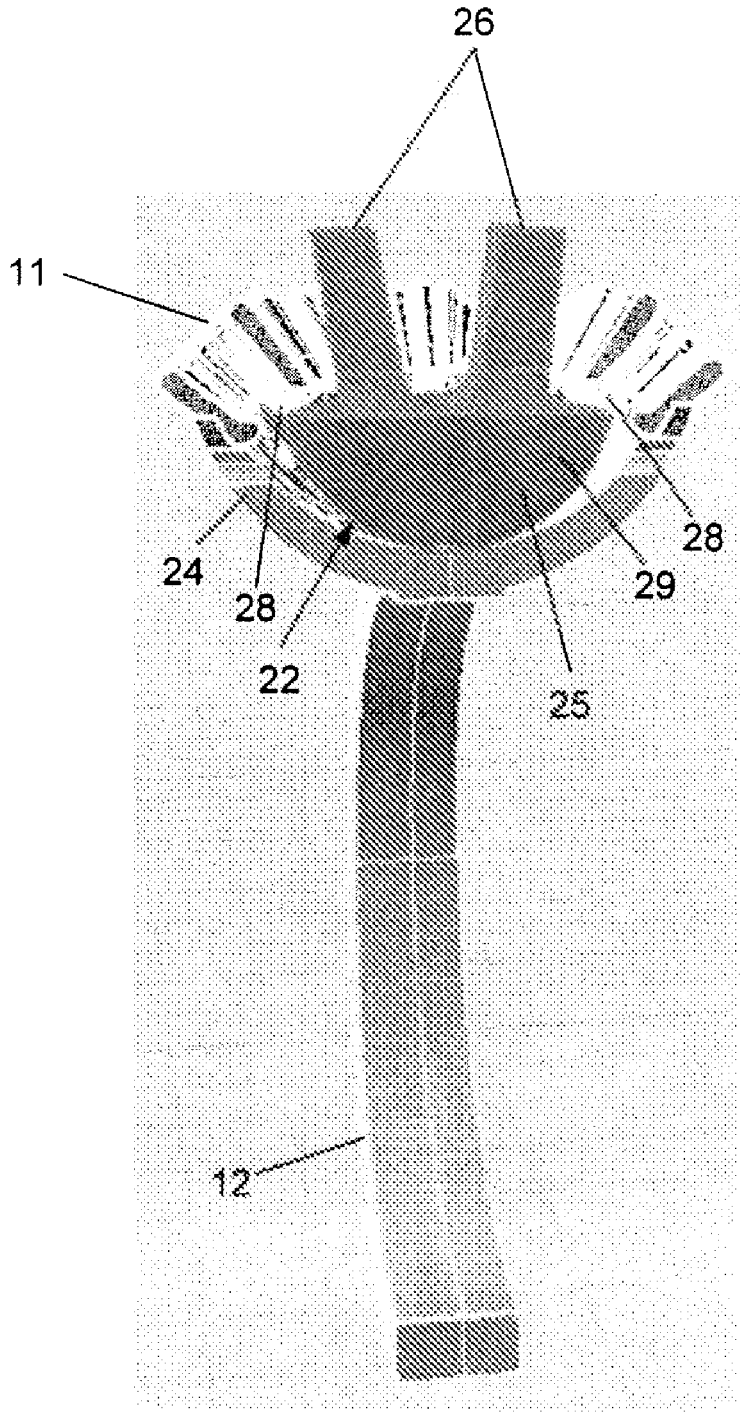
Figure 2C:
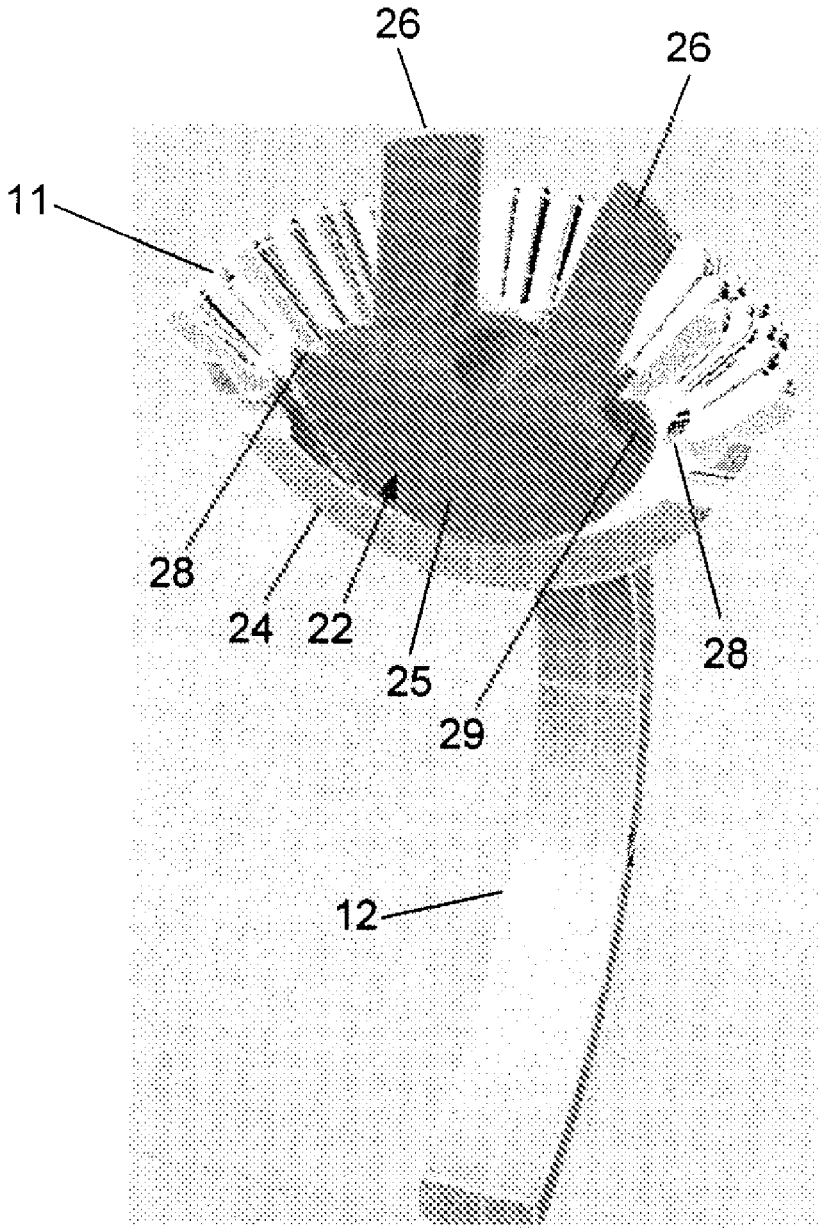

FIGS. 2*a*-2*c* are cut-away views of a ring 12 comprising a dynamic bezel 22 tilting within its partially spherical concave seat 24, a dynamic prong setting bezel 22 attached to ring 12 by means of holder 11. As shown in FIGS. 2*a*-2*c*, holder 11 holds the dynamic prong setting bezel 22 within the partially spherical concave seat 24, while still allowing the bezel upper side containing prongs 26 to emerge from a hole at t he center of holder 11 providing it a multi-directional freedom of movement. More specifically, holder 11 holds the dynamic prong setting bezel 22 in its place using inner curb 28 which allows the bezel upper side containing prongs 26 to have freedom of movement while also limiting the movement of bezel 22 to some boundaries.

The upper side 29 of partially spherical base 25 is wider than holder 11 inner curb 28, thus, enabling the holding of the dynamic prong setting bezel 22 by inner curb 28. However, at the location of contact between holder 11 and prongs 26, the hole diameter is greater than the span of prongs 26 at that location, such that a limited movement of bezel 22 is enabled. Further, the volume of the partially spherical concave seat 24 is slightly greater than the volume of the partially spherical base 25, thus, enabling a limited movement of bezel 22 within the partially spherical concave seat 24. In other words, the radius of curvature of partially spherical concave seat 24 is greater than the radius of curvature of partially spherical base 25. The right edge of Inner curb 28 blocks the right edge of the partially spherical base 25 upper side 29 (as shown in FIG. 2*a*) when bezel 22 tilts to the left, thus, limiting the movement of bezel 22. FIG. 2*c* discloses the equivalent process when bezel 22 tilts to the right. The left edge of Inner curb 28 blocks the partially spherical base 25 upper side 29 left edge, when bezel 22 tilts to the right, thus, limiting the movement of bezel 22. As shown in FIG. 2*b*, the weight of the partially spherical base 25 enables its return to its vertical initial position when said dynamic piece of jewelry is not in motion.

Figure 3:
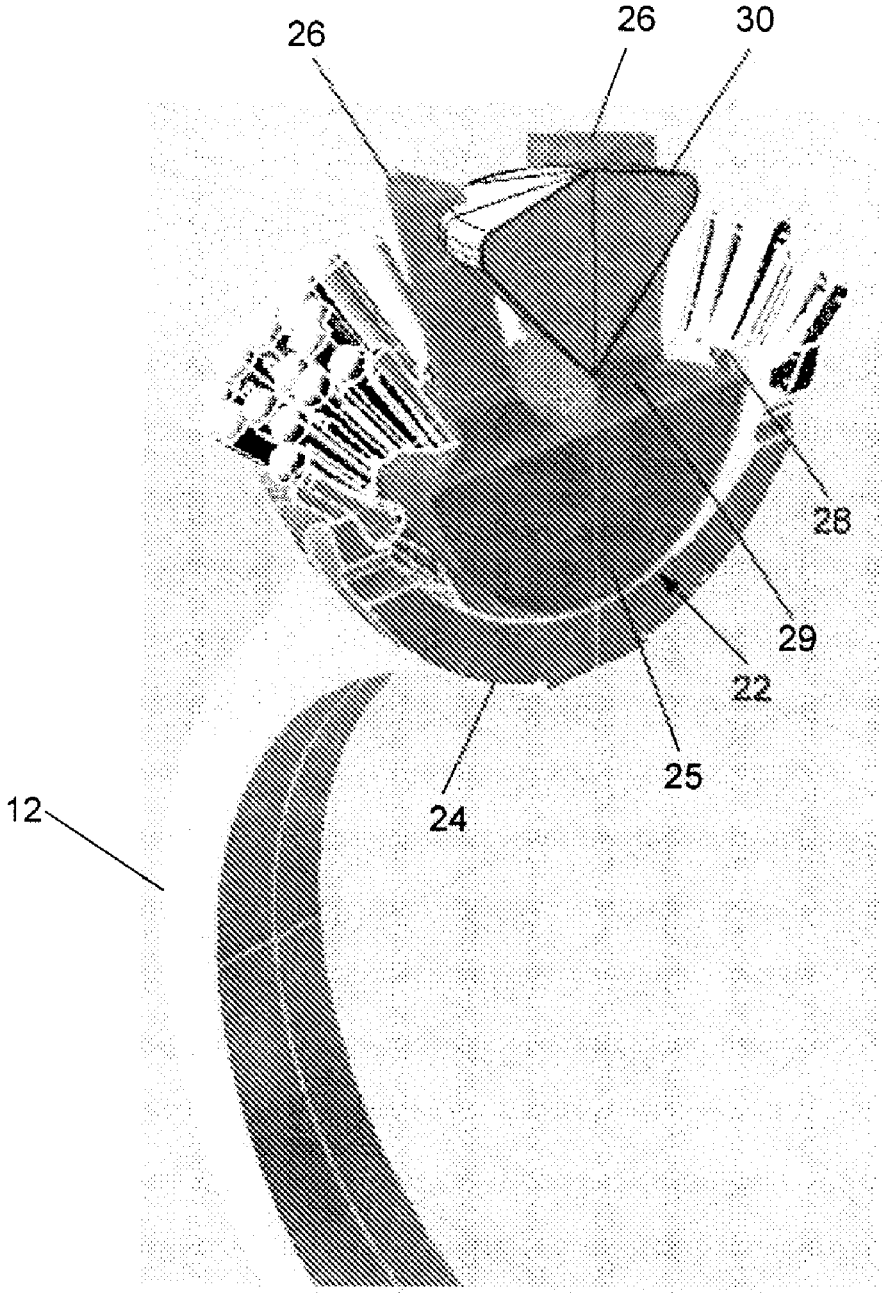
FIG. 3 is a cut-away perspective view of a ring comprising a dynamic prong setting bezel set with a gemstone.
Figure 4:
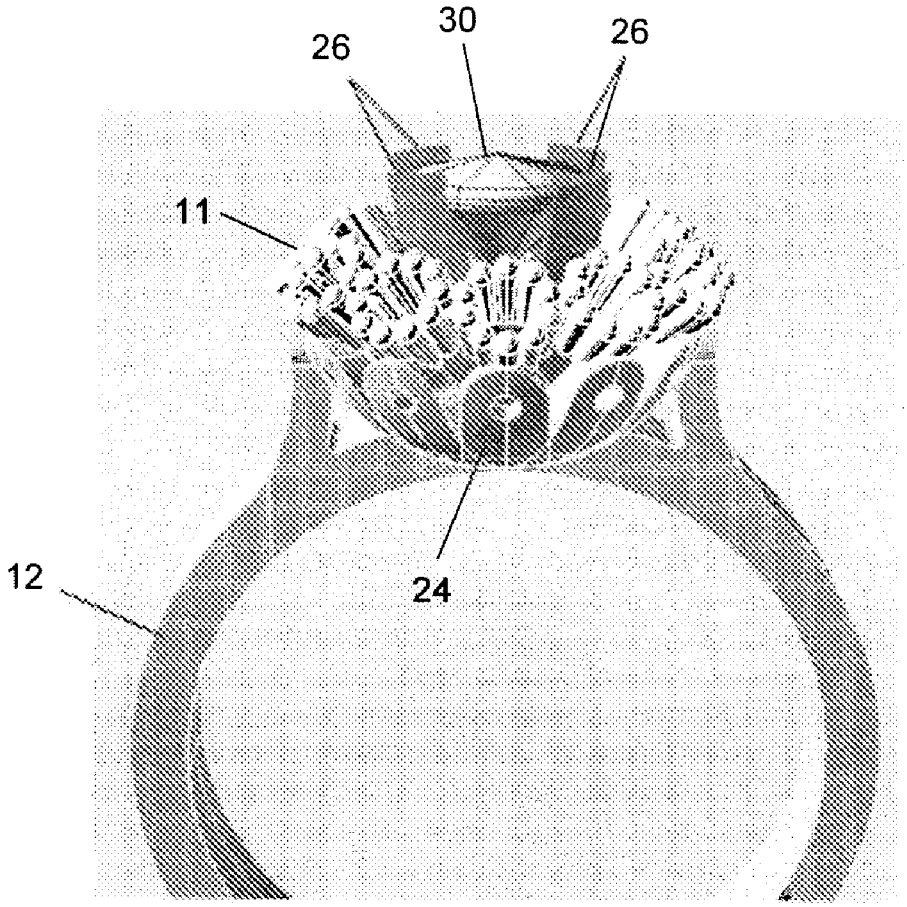
FIG. 4 is a front view of a ring comprising a dynamic prong setting bezel set with a gemstone.

The abovementioned movement increases the Scintillation and Contrast levels of gemstone 30 (shown in FIGS. 3 and 4) which is positioned on the dynamic prong setting bezel 22. More particularly, the gemstone movement changes dynamically the reflection of light, as seen by an observer, giving the gemstone a significantly richer view.

Although the dynamic bezel seat 24 disclosed in this embodiment has been shown as having a partially spherical concave shape, this seat can be flat or having another shape, as long as it provides the partially spherical base 25 nesting within it with enough space to freely move within some boundaries.

Although embodiments of the present invention have been described by way of illustration, it will be understood that the invention may be carried out with many variations, modifications, and adaptations, without departing from its spirit or exceeding the scope of the claims.

The invention claimed is:

1. A dynamic piece of jewelry, which comprises:

a bezel comprising:

a. a partially spherical base having a curved bottom and an essentially flat top; and b. plurality of prongs that extend in a tilted manner from said essentially flat top of the base, each of said prongs having a bottom end which is attached to said essentially flat top of said base, and a top end, and wherein said prongs are tilted such that they form a structure having an expanding cross section from the structure bottom to the structure top;

c. a tooth at the top of each prong, for, jointly supporting a gemstone;

a seat which supports said partially spherical base, said seat having a radius of curvature larger than the radius of curvature of said partially spherical base;

a gemstone supported by said plurality of teeth at the top of said prongs; and a holder having a central hole, said holder being attached to said seat in such a manner that a top portion of the prongs including the gemstone protrude above said holder hole, and a bottom portion of said prongs and said partially spherical base being maintained below said holder, and wherein the cross section of said prongs structure at the holder level is slightly smaller than the hole, thereby enabling multi directional freedom of movement, although limited, of the bezel within said the limitation of said hole.

2. Jewelry according to claim 1, wherein the energy for the limited movement of the bezel is derived from the movement of the person wearing said jewelry.

3. Jewelry according to claim 1, wherein the holder comprises inner curbs that limit the movement of the bezel.

4. Jewelry according to claim 1, wherein the seat has a partially concave spherical structure.

5. Jewelry according to claim 1, wherein portion of the seat which supports said partially spherical base of the bezel is flat.

6. Jewelry according to claim 1, wherein the bezel is a prong setting type bezel.

* * * * *